United States Patent [19]

Arikawa

[11] 4,349,805

[45] * Sep. 14, 1982

[54] QUICK-ACTING MICRO-FUSE

[75] Inventor: Hiroo Arikawa, Tokyo, Japan

[73] Assignee: San-O Industrial Co., Ltd., Tokyo, Japan

[ * ] Notice: The portion of the term of this patent subsequent to May 12, 1998, has been disclaimed.

[21] Appl. No.: 149,590

[22] Filed: May 12, 1980

Related U.S. Application Data

[63] Continuation-in-part of Ser. No. 93,378, Nov. 13, 1979, Pat. No. 4,267,543.

[51] Int. Cl.[3] ..... H01H 85/48

[52] U.S. Cl. ..... 337/255; 337/198; 337/260

[58] Field of Search ..... 337/186, 187, 198, 255, 337/260, 263; 29/623

[56] References Cited

U.S. PATENT DOCUMENTS

| | | | |
|---|---|---|---|
| 2,383,484 | 8/1945 | Holmes | 337/260 |
| 3,110,787 | 11/1963 | Borzoni | 337/260 |
| 3,227,841 | 1/1966 | Gaia | 337/255 |
| 3,436,711 | 4/1969 | Borzoni | 337/198 |

*Primary Examiner*—William H. Beha, Jr.

[57] ABSTRACT

A quick-acting micro-fuse comprising a fuse base and body, a fuse cover and a pair of electrically conductive lead wires. The lower ends of the conductive wires protrude from the fuse base and their upper ends are embedded into the fuse base and body. The fuse body comprises a pair of opposed, spaced apart and generally crescent-shaped members, each member having an outwardly curved surface, generally flat top and bottom surfaces and a generally perpendicular inner wall through which the lead wires extend, terminating at the same level as the crescent shaped numbers. A fusible element is stretched between the upper ends of the lead wires and is secured thereto, e.g., by soldering.

5 Claims, 8 Drawing Figures

QUICK-ACTING MICRO-FUSE

RELATED APPLICATIONS

This application is continuation-in-part of application Ser. No. 93,378 filed Nov. 13, 1979, now U.S. Pat. No. 4,267,543, 9/22/80.

BACKGROUND OF INVENTION

Quick acting miniature electric fuses have been widely used in various electric and electronic circuits. In most of these fuses, the fusible element is either soldered to the ends of the lead wires or it is simply secured thereto mechanically.

One type of miniature fuse is described in U.S. Pat. No. 3,227,841, issued to Aldens J. Gaia on Jan. 4, 1966. This fuse comprises a hollow housing made of an insulating material such as a refractory material, an electrically non-conductive disc also made of a refractory material and mounted in said housing and a pair of electrically conductive terminals extending through a pair of spaced openings in said disc mounting. The two terminals are partially enclosed in the housing and a fusible conductor stretches between the enclosed ends of said terminals and is soldered thereto at both ends.

Another type of fuse comprises a housing which includes a base made of an insulating material and a pair of lead wires passed thorugh the base partially into the housing. Each tip of the lead wires is bent and a fusible conductor stretches between these tips with the ends of the fusible elements secured to the respective tips of the lead wires by means of an electrically conductive paste. This type of fuse is described in Japanese Utility Patent 43-7710.

These prior fuses, however, are extremely unstable since the length of the fusible element is subject to variations, and evaporation of the electrodes due to arcing heat tends to prolong the arcing time. Accordingly, these fuses have not been entirely satisfactory.

In another type of fuse which is described in British Pat. No. 969,654, published on Sept. 16, 1964, the fuse comprises an integral fuse body through which extends a pair of spaced lead wires projecting beyond opposite ends of the fuse body, and a fusible element between the two ends of the lead wires in the fuse body. The fusible element and the lead wires are wholly embedded in a solid, arc-quenching filler made of epoxy resin and an imperforate cup-shaped cap is fitted over the fuse body to encase the fusible element, the lead wire portions in the fuse body and the epoxy resin filler.

The difficulty with fuses using epoxy fillers, however, is that, the heat generated by the passage of electric current causes thermal expansion with subsequent contraction when current flow is interrupted. Repeated thermal expansions and contractions often cause breakdown of the fusible element.

Accordingly, it is an object of this invention to provide a micro-fuse which is substantially free from the aforesaid inherent drawbacks of the prior fuses.

It is a further object of this invention to provide a micro-fuse which is quick acting and has improved arc-extinguishing characteristic.

It is also an object of this invention to provide such a fuse which also exhibits improved stability and thermal capacity.

The foregoing and other objects of this invention will be described in detail in the ensuing description of the preferred embodiment of the invention taken in conjunction with the accompanying drawings.

SUMMARY OF INVENTION

In accordance with this invention a quick-acting micro-fuse is provided which, due to its unique construction and arrangement of its component parts, exhibits short arcing time after blowout of the fusible element, improved thermal stability and capacity, and superior arc-quenching characteristic. The fuse comprises a fuse base and body, a fuse cover which is capped onto the fuse body, and a pair of electrically conductive lead wires protruding from the fuse base and partially embedded into the fuse body. The fuse body comprises a pair of opposed, spaced apart, generally crescent-shaped members, each member being defined by an outwardly curved surface, generally flat top and bottom surfaces and generally perpendicular inner wall, wherein each of said inner walls is spaced apart and is in parallel facing relation to one another. The respective embedded ends of the conductive terminals may be disposed at the same level as the generally flat top of each crescent-shaped member or they may be disposed midway in each of said members.

In one embodiment, a groove is cut in each of said crescent-shaped members from their top surfaces to midway in said members and thereafter angled horizontally relative to the inner walls of said members. A fusible element is stretched between the conductive terminals of the fuse, with the ends of the fusible element either resting on the flat top of said crescent-shaped members, or at the bottom of said grooves, as the case may be, and are either bonded or soldered thereto.

In a further embodiment of the invention, in order to improve the thermal capacity of the fuse and to prevent the solder material from scattering about in case of a blowout, a metal plate (e.g., a brass plate) is placed on top of the solder surface and is bonded or soldered thereto for added safety.

BRIEF DESCRIPTION OF THE DRAWINGS

In the drawings, wherein like reference numerals are employed to designate like parts.

DETAILED DESCRIPTION OF INVENTION

Figure 1:
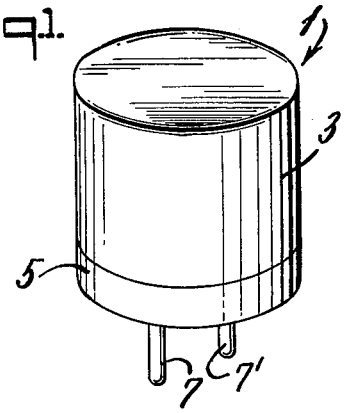
FIG. 1 is a perspective exterior view of the different embodiments of the fuse of this invention capped and ready for installation.

Referring now to the drawings, and first to FIG. 1 there is shown the micro-fuse of this invention generally designated as 1 comprising a fuse cap or cover 3 capped onto a fuse base 5, and a pair of electrically conductive terminals or electrodes 7,7' protruding from the fuse base 5.

Figure 2:
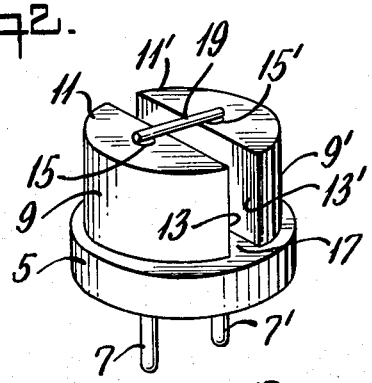
FIG. 2 is a perspective view of the fuse shown in FIG. 1 with the fuse cap removed.

With reference to FIG. 2, the fuse body comprises a pair of generally crescent-shaped, substantially identical, opposed and spaced apart members 9,9' which are defined by generally flat top surfaces 11,11' relatively flat bottom surfaces (not shown) and inner, generally perpendicular facing walls 13,13', which are spaced apart and substantially parallel to one another, and which define a generally U-shaped valley or space 17.

In the embodiment illustrated in FIGS. 2–4 (hereinafter Embodiment I), the upper ends of the electrodes 7,7' terminate at the same level as the top surfaces 11,11' of the crescent-shaped members 9,9' as at 15,15' (See FIG. 4).

Figure 3:
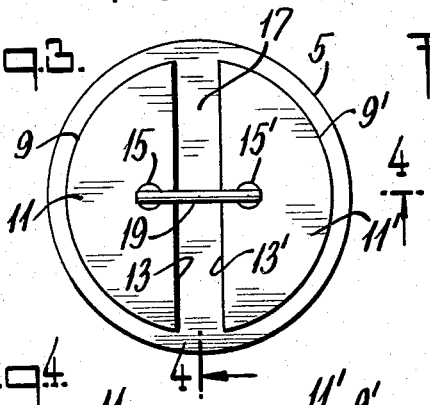
FIG. 3 is a plan view of the fuse shown in FIG. 2.
Figure 4:
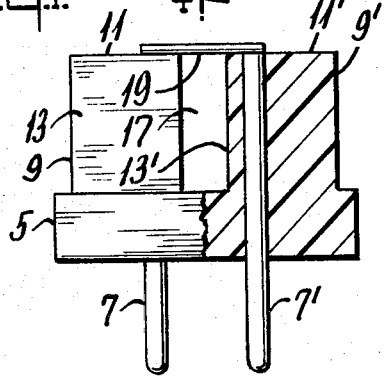
FIG. 4 is a sectional view taken along the line 4—4 in FIG. 3.

Further referring to FIGS. 2–4, a fusible element 19 (e.g., an electrically conductive wire) is stretched between the ends of the electrodes 7,7' and are bonded, soldered or otherwise rigidly secured thereto. Since the electrodes are firmly embedded in the crescent-shaped members 9,9', the micro-fuse construction of EWMBODIMENT I of this invention insures that the length of the fusible element 19 remains invariable during current flow. This factor is significant in the stabilization of the fuse during blowout.

There are other advantages which are realized from the novel micro-fuse construction of Embodiment I of this invention. Since the fusible element 19 is electrically connected to the electrodes 7,7' by bonding or soldering and the ends of the electrodes do not protrude beyond the top surfaces 13,13' of the crescent-shaped members, the anti-arcing characteristics of the fuse, i.e., the capacity of the fuse to prevent arc generation, is improved remarkably. Moreover, the generally U-shaped valley defined between the opposing walls of the crescent-shaped members serves to increase the creeping distance between the electrodes 7,7' and improve the insulating capacity of the fuse. Since no epoxy resins or similar materials are used as in the aforementioned British patent, breakdown of the fusible element due to changes in thermal cycles is minimized considerably.

Figure 5:
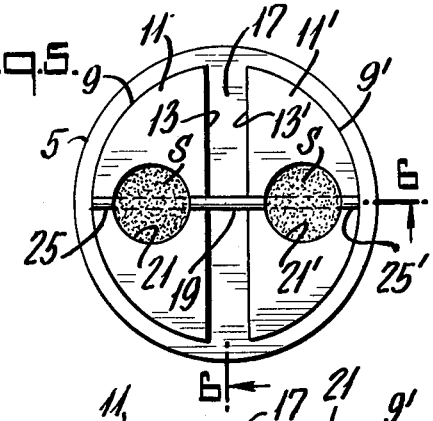
FIG. 5 is a plan view of a different embodiment of the fuse of this invention.
Figure 6:
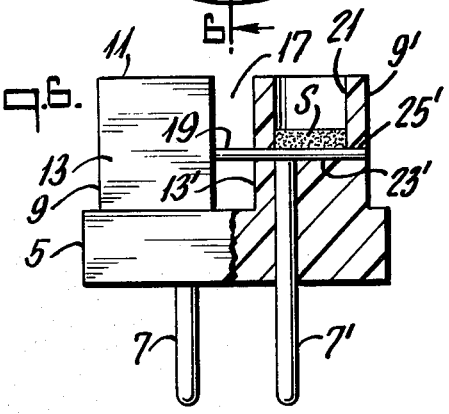
FIG. 6 is a sectional view taken along the line 6—6 in FIG. 5.

In a different embodiment of this invention as illustrated in, and described with reference to, FIGS. 5 and 6 (hereinafter Embodiment II), the electrodes 7,7' extend through the respective crescent-shaped members 9,9' terminating midway therein. In Embodiment II, each crescent-shaped member includes a generally round hole or cavity such as 21,21' which extends from the top surfaces of each crescent-shaped member and are defined by and completely insulated within the walls of said members, with the upper ends of electrodes 7,7' terminating at the same level as the bottoms 23,23' of said cavities.

A pair of axially aligned grooves 25,25' having slightly larger diameter than the fusible element are cut in each of the crescent-shaped members 9,9' midway between the top and bottom surfaces of said members. The grooves 23,23' are cut at the middle edges of the respective walls 13,13' at right angles thereto and serve to place the fusible element 19 therein. The fusible element 19 is placed on the bottom of said grooves and is stretched between the two electrodes 7,7' with the ends of the fusible elements being soldered to the respective ends of said electrodes exposed at the bottom of each of said cavities by means of a solder material. Because of its extremely low surface tension, the solder material remains in said cavities 21,21' without flowing into said grooves.

The micro-fuse described in Embodiment II of this invention is not only quick acting but also exhibits accurate thermal capacity and stabilized blowout characteristic. Moreover, since the diameter of the grooves are slightly larger than the diameter of the fusible element, arcing rarely occurs after blowout of the fusible element.

Figure 7:
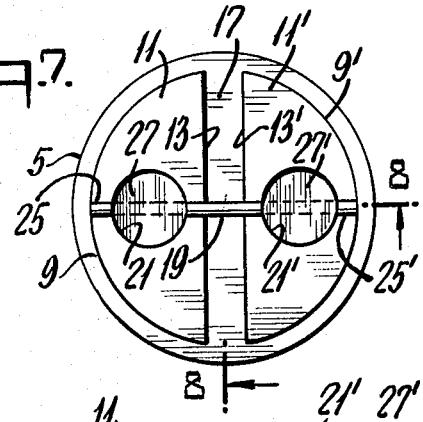
FIG. 7 is a plan view of another embodiment of the fuse of this invention.
Figure 8:
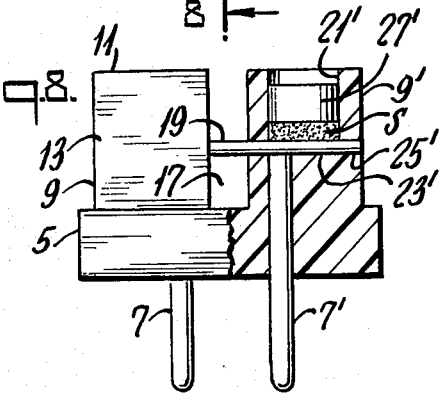
FIG. 8 is a sectional view taken along the line 8—8 in FIG. 7.

A still another and different embodiment of this invention is illustrated in, and described with reference to, FIGS. 7 and 8 (hereinafter Embodiment III). This embodiment is similar to Embodiment II except that in each of the cavities 21,21' is inserted a brass plate 27,27' which has a slightly smaller diameter than the cavities. The brass plate is placed on the solder material in each of said cavities and is soldered together with the ends of the fusible element 19 and the electrodes 7,7'. By varying the thickness of each brass plate, the thermal capacity of the electrodes can be altered at will. Greater thermal capacity affords a quicker acting fuse with higher thermal capacity.

The advantage of the quick-acting micro-fuse of this invention will become more apparent from the following comparative table (Table I) wherein the properties of the fuse of Embodiment I is compared with a fuse made according to the aforementioned Japanese Pat. No. 43-7110 in which the fusible element is simply secured to the ends of the lead wires (electrodes).

TABLE I

| | Japanese Patent | Embodiment I |
|---|---|---|
| Rated Current | 62 mA | 62 mA |
| Blowout time for rated current × 200 | 1–30 seconds | 2–5 seconds |
| Arcing time at DC 15A | 20–900μ sec. | 2–3μ sec. |
| Voltage resistance after current interruption | DC 50 V | DC 80 V |
| Distance between electrodes | 2.54 mm | 1.95 mm |

From Table I it is clearly evident that even though the distance between the electrodes in the fuse of Embodiment I is shorter than the distance between the electrodes of the fuse in the prior art Japanese Patent, yet the voltage resistance is considerably larger. In addition, the fuse described in Embodiment I of this invention is superior in that it exhibits considerably shorter blowout time and remarkably decreased arcing time, and hence, superior overall performance characteristics.

In Table II below, the blowout time, arcing time and voltage resistance of a fuse constructed in accordance with Embodiment II of this invention are compared with those of a fuse constructed in accordance with the aforementioned British Pat. No. 969,654.

TABLE II

| | British Patent | Embodiment II |
|---|---|---|
| Rated Current | 62 mA | 62 mA |
| Temperature test | | |
| −30° C. 3 hours } 1 cycle | rejection rate | rejection rate |
| 70° C. 3 hours } 1 cycle | 12% | 0% |
| | after 100 cycles | after 100 cycles |
| Number of samples n = 100 | | |
| Voltage resistance after interruption | DC65V | AC DC125V |
| Distance between the electrodes | 2.54 mm | 1.95 mm |

As seen from Table II, Embodiment II of the invention not only can withstand use for a long period, but is also excellent in its voltage resistance capacity, therefore, it can interrupt more efficiently than the fuse described by the aforementioned British patent, the overload current, if any, flowing from the power source.

TABLE III

| | Japanese Patent | British Patent | Embodiment III |
|---|---|---|---|
| Rated Current | 62 mA | 62 mA | 62 mA |
| Current Carrying Capacity Rated Current × 100% 10 sec. on, 10 sec. off } one cycle n = 100 | 13,900 cycles in average until blow-out | 4,660 cycles in average until blow-out | no blowout even after more than 30,000 cycles |
| Blowout time + arcing time Interruption time at DC15A | 30-910μ sec | 25-40μ sec | 10-12μ sec. |

As shown in Table III, the quick-acting micro-fuse of this invention is superior to both the prior art type fuses described in the aforementioned Japanese and British patents.

While, the fuse of this invention has been described with a certain degree of particularity, it must be understood that such description is not intended to restrict or limit the scope of this invention. Several changes or modifications can be made in the construction of the fuse which are nevertheless comprehended from the detailed disclosure herein and which are therefore within the spirit and contemplation of this invention.

What is claimed is:

1. A quick-acting micro-fuse comprising a fuse base and body, a fuse cover, a pair of electrically conductive lead wires, the lower ends of which protrude from said base and the upper ends of which are embedded into said fuse base and body, a pair of opposed, spaced apart and generally crescent-shaped members, each of said members being defined by an outwardly curved surface, generally flat top and bottom surfaces and a generally perpendicular inner wall, wherein said inner walls are spaced apart and in facing relation to one another and wherein the upper ends of said electrically conductive lead wires terminate at about the same level as said top surfaces of said crescent-shaped members, and a fusible element stretched between said upper ends of the electrically conductive lead wires and secured thereto at each end.

2. A quick-acting micro-fuse as in claim 1 wherein said inner walls and said fuse base define a generally U-shaped space between said electrically conductive lead wires.

3. A quick-acting micro-fuse comprising a fuse base and body, a fuse cover, a pair of electrically conductive lead wires, the lower ends of which protrude from said fuse base and the upper ends of which are embedded into said fuse base and body, a pair of opposed, spaced apart and generally crescent-shaped members, each of said members being defined by an outwardly curved surface, generally flat top and bottom surfaces and a generally perpendicular inner wall, wherein said inner walls are spaced apart and in facing relation to one another and each of said crescent-shaped members include a generally circular cavity extending from its top surface to midway therein, and wherein the upper ends of each of said electrically conductive lead wires terminate near the bottom of each of said cavities, a pair of axially aligned grooves, each of said grooves being formed perpendicularly from the top surface of each of said members to a finite distance therein corresponding to the ends of said lead wires, and thereafter at right angle relative to said inner walls, and a fusible element disposed within said grooves and stretched between the ends of said lead wires and soldered thereto by solder means.

4. A quick-acting micro-fuse as in claim 3 further including a metal plated fitted into each of said cavities, wherein said metal plate is placed on the surface of the solder and soldered together with the ends of said fusible element and said lead wire.

5. A quick-acting micro-fuse as in claim 4 wherein said metal plate is made of brass.

* * * * *